US005900568A

United States Patent [19]

Abrams

[11] Patent Number: 5,900,568

[45] Date of Patent: May 4, 1999

[54] METHOD FOR AUTOMATIC SOUND SYNTHESIS

[75] Inventor: Steven R. Abrams, New City, N.Y.

[73] Assignee: International Business Machines Corporation, Armonk, N.Y.

[21] Appl. No.: 09/080,323

[22] Filed: May 15, 1998

[51] Int. Cl.[6] ..... G10H 7/00; G10H 7/10

[52] U.S. Cl. ..... 84/622; 84/601; 84/608; 84/626; 84/659

[58] Field of Search ..... 84/601–608, 615, 84/622–625, 626, 645, 659–661

[56] References Cited

U.S. PATENT DOCUMENTS 5,173,567 12/1992 Fujita ..... 84/607
5,461,189 10/1995 Higashi et al. ..... 84/601
5,578,781 11/1996 Suzuki ..... 84/661

*Primary Examiner*—William M. Shoop, Jr.
*Assistant Examiner*—Marlon T. Fletcher
*Attorney, Agent, or Firm*—Whitham, Curtis & Whitham; Steven C. Kaufman

[57] ABSTRACT

A method for automatically adjusting the parameters of a synthesizer includes generating a first synthesized signal based on an initial set of synthesizer parameters, comparing the first synthesized signal to an input sound signal, and generating a control signal for adjusting a subset of parameters of the synthesizer to minimize the differences between the first synthesized signal and the input sound signal. These steps may be iteratively performed for a predetermined number of additional subsets of synthesizer parameters, until a final output of the synthesizer is obtained which represents an optimization of the synthesis of the input sound signal.

22 Claims, 6 Drawing Sheets

METHOD FOR AUTOMATIC SOUND SYNTHESIS

BACKGROUND OF THE INVENTION

1. Field of the Invention

This invention generally relates to sound generation, and more particularly to a method for controlling a synthesizer to produce a desired sound.

2. Description of the Related Art

Sound synthesis systems have been known for years. These systems generate sound by controlling one or more of the frequency and timbral characteristics of an initial signal. Early sound synthesizers generated sound by adjusting just a few parameters to control equalization characteristics (e.g., base and treble) of a reference signal. As technology progressed, so did the level of complexity of sound synthesis control. Today, literally scores of parameters are considered for adjustment.

While sound synthesizers have a variety of uses, there is, perhaps, no more common application than to the synthesis of musical sounds. Musical sound synthesis requires controlling an input reference signal over a wide dynamic range in order to accommodate the frequency characteristics of the different instruments forming the music.

Piano and guitar tones, for example, rise quickly to an initial maximum, then gradually decay. Orchestral instruments, on the other hand, dampen quickly when playing ceases. Further, many musical tones have characteristic transients which greatly influence timbre. In organ tones, for example, the transients are of different fundamental frequencies, and they tend to appear and decay before steady state is reached. In percussive tones, on the other hand, the initial transient is the cause of the tone and the final transient is the result.

Other applications of sound synthesis technology include speech synthesis, ambient sound reproduction, and sound effects generation as, for example, in video games, movies, and other forms of entertainment. Sound synthesis has also been used-to advance a number of military objectives.

Sound synthesizers may be digital or analog. One type of digital synthesis technique is sample-based synthesis, which has been in existence for nearly twenty years under various names including "sample playback" and "wave table" synthesis. Sample-based synthesizers produce sound by playing back stored digital recordings. The playback is digitally "sped up" or "slowed down" to alter pitch, thereby allowing a single recording to be used for a range of pitch playback. Further, to generate sustained notes for periods of time longer than on the recording, a technique is employed to "loop" a portion of the sample.

FIG. 1 shows a conventional sample-based synthesizer 100 equipped with time-varying filters 101, modulators 102, and oscillators 103. In operation, the synthesizer controls these elements to generate a synthesized output that can very closely mimic a non-synthesized sound. If the input digital sample is of an instrument, for example, the synthesizer will adjust the parameters of one or more of its filters, modulators, and oscillators to generate a sound mimicking playing of the instrument, with all its attendant dampening and sustaining characteristics.

The quality of sound generated by a digital synthesizer is dependent upon a number of factors. First and foremost is the quality of the digital samples themselves, which serve as references for the synthesis. Increasing the quality of digital samples is one technique that can be employed to improve sound synthesis. There are, however, countervailing considerations to this approach. As is always the case in digital recordings, a balance between storage space and desired quality must be struck. Factors such as sampling frequency, sample word-length, length of the sample, and number of samples used are all critical. For example, 30 seconds of 24 bit samples at 96 kHz will make for a much better quality sound than 5 seconds of 8 bit 22.1 kHz samples, but the former will also substantially increase the storage requirements of the synthesizer.

Another factor affecting the quality of sound from a digital synthesizer is the selection of loop points. A careless selection of loop points can result in a buzzing or clicking effect. Further, to convey the timbre of the instrument, a long enough sample segment must be looped. The longer the loop, however, the more of the sample which must be stored. Thus, it is clear that, along with other factors, the length of the loop affects the memory requirements of the synthesizer.

Another factor is the filters and modulators used to generate the sound. These circuits are typically controlled in order to mimic the natural decay of the sound of an instrument in the synthesized output. Use of such filters applied during the looped portion of the sample playback, for example, can allow for a much shorter sample loop while still maintaining a faithful reproduction of the sound of the instrument. Decay, reverberation, and other effects are also generated through control of these circuits.

One of the latest incarnations of sound synthesizers is their embodiment in software for use on a computer. Examples include "Reality" by Seer Systems and "Creative WaveSynth/WG" by Creative Labs. Wave-table synthesis cards, such as the Creative Labs AWE64, have also been developed. Typically, these devices are controlled by software on a personal computer and serve as standard or inexpensive optional equipment with greatly reduced storage and bandwidth capabilities. With careful programming, however, wave-table synthesis cards can do a credible job at many synthesis tasks. For example, these cards have found particularly useful application when used with gaming and entertainment software. Microsoft, through their Direct Music API, supports the Downloadable Sound ("DLS") standard to serve such a purpose.

Conventional sound synthesizers have a number of drawbacks. Perhaps most significantly, these systems rely on a completely manual process to design a synthesized sound, or "patch." The skill and experience of each individual technician, thus, almost invariably dictate the quality of output of the synthesizer.

To generate the multiple synthesized sounds typically offered on musical sound synthesizers today a technician must manually adjust the parameters of the synthesizer to produce, in his best estimation, an output which most closely mimics a sound. This at least requires a thorough understanding of the structural and function configuration of the system, and how the various features therein may be interrelated to produce sound. Since the number of parameters considered for adjustment often number 50, 60, or more, this becomes a complex and tedious endeavor. As an example, the Kurzweil 2500S synthesizer is a sample-based sound synthesizer which mimics various musical instruments by allowing for adjustment of over a hundred parameters, each of which directly impacts the resulting sound.

The combination of artistic and technical skills required to program a sample-based synthesizer, thus, has, almost by necessity, relegated synthesis patch design to a "black art," with relatively few skilled practitioners. Lay users are, for all intents and purposes, excluded from such an undertaking, since it would likely take them hours to, one, familiarize themselves with the operation and configuration of the synthesizer, and, two, adjust the likely scores of parameters required to generate a high-quality synthesized sound.

It is therefore apparent that a need exists for a method of controlling a synthesizer, digital or analog, to generate sound in a more efficient and less costly manner compared with their conventional counterparts, and moreover one which allows lay persons to program a synthesizer to generate customized sounds of a quality at least equal to that attainable by a skilled technician practicing conventional manual methods.

SUMMARY OF THE INVENTION

It is one object of the present invention to provide a method for controlling a sound synthesizer to generate sound in a more economical and efficient manner compared with conventional techniques.

It is a another object of the present invention to provide a method for controlling a synthesizer which can, with ease, be implemented by lay persons to generate customized sounds of a quality at least equal to that attainable by a skilled technician manually adjusting the parameters of the synthesizer.

It is another object of the present invention to achieve the foregoing objects by providing a method which automatically adjusts one or more of the parameters of a synthesizer required to generate a desired sound.

It is another object of the present invention to provide an automatic method of the aforementioned type which is versatile, in that can be adapted to control the generation of sound from any type of synthesizer, whether digital or analog.

It is another object of the present invention to provide an automatic method of the aforementioned type which is at least partially embodied within a program adapted for implementation on a computer or other processing device.

The foregoing and other objectives of the invention are achieved by providing a method which includes, in accordance with a first embodiment, inputting a sound signal into a synthesizer to produce a first synthesized signal based on a predetermined set of parameters, comparing the first synthesized signal to the sound signal to derive an error signal indicative of differences between the first synthesized signal and the sound signal, and generating a control signal for adjusting a first set of parameters based on the error signal. The control signal adjusts the first set of parameters to reduce differences between the first synthesized signal and the sound signal, and preferably optimally so. These steps are then analogously performed for subsequent sets of parameters, until the synthesizer is adjusted in such a way as to generated a high-quality, and even optimum, synthesis of the input sound signal. In the first embodiment, the synthesizer being controlled may be analog or digital.

In a second embodiment, the method is specifically applied to adjust the parameters of a digital, sample-based synthesizer to cause the synthesizer to produce a high-quality synthesis of a digitized input sound signal.

In a third embodiment, the method of the present invention controls a synthesizer of a type which internally generates a synthesized sound, i.e., one that internally synthesizes a sound. According to this method, a sound signal to be synthesized is selected, a first synthesized signal internally generated by the synthesizer is compared to the sound signal to derive an error signal, and control signals are generated for adjusting one or more sets of parameters of the synthesizer to thereby generate a high-quality synthesis of the sound signal.

Advantageously, the number of sets of parameters to be adjusted may be increased as desired to optimize synthesis of a sound. The steps of the method may also embodied within a computer program implementable on a personal computer, or other processing device, adapted for interface to the synthesizer, which may also be implemented in software or hardware. For consolidation and convenience purposes, the synthesizer itself may be modified to implement the method.

DESCRIPTION OF THE PREFERRED EMBODIMENTS

The present invention is a method for controlling a synthesizer to produce a desired sound. The synthesizer may be analog or digital, specially made or commercially available, software- or hardware-based, and the sound may be a single sound or an arrangement of sounds produced from, for example, a musical instrument or a human being, e.g., speech. The sound may also be an ambient sound (e.g., wind, waves, waterfall, rain, etc.), or one produced from an animal (e.g., a lion's roar, a dog's bark) or an object such as a sound effect (e.g., breaking glass, gun) for use in movies and video games, or for other entertainment or audiovisual purposes.

To control the generation of sound, the method of the present invention automatically adjusts one or more sound-altering parameters of a synthesizer that will cause the synthesizer to generate, preferably optimally, a desired sound over a variety of pitches, and if desired, with differing timbers, reverb, chorus, and other effects. The method of the present invention, thus, performs, easily and efficiently, a task which, before, could only be performed by a skilled technician according to a tedious and painstaking manual process. Lay persons and skilled technicians alike, thus, may advantageously use the present method to synthesize virtually any sound conceivable.

Figure 1:
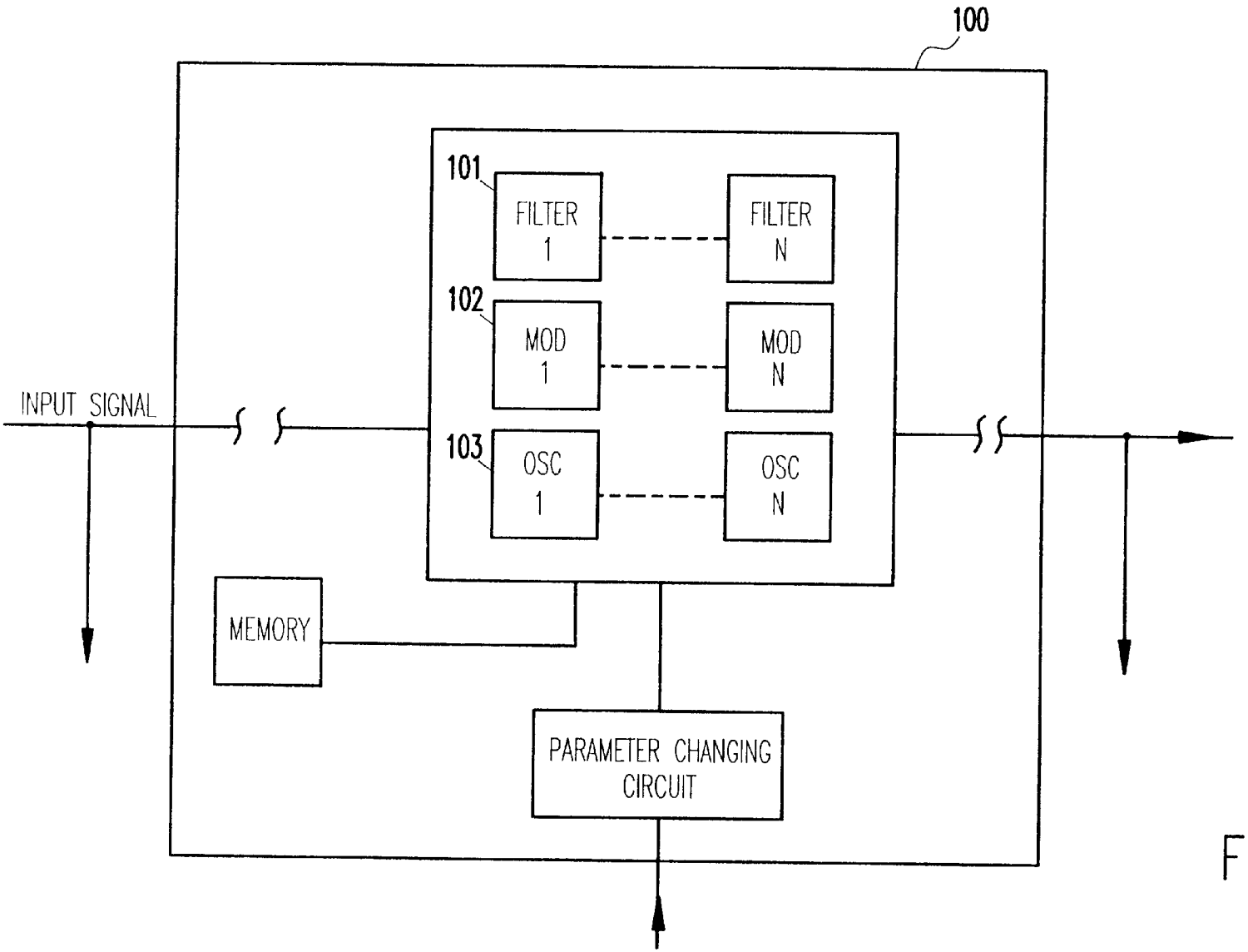
FIG. 1 is a schematic diagram of a conventional synthesizer containing one or more filters, modulators, and oscillators for reproducing an input sound.
Figure 2:
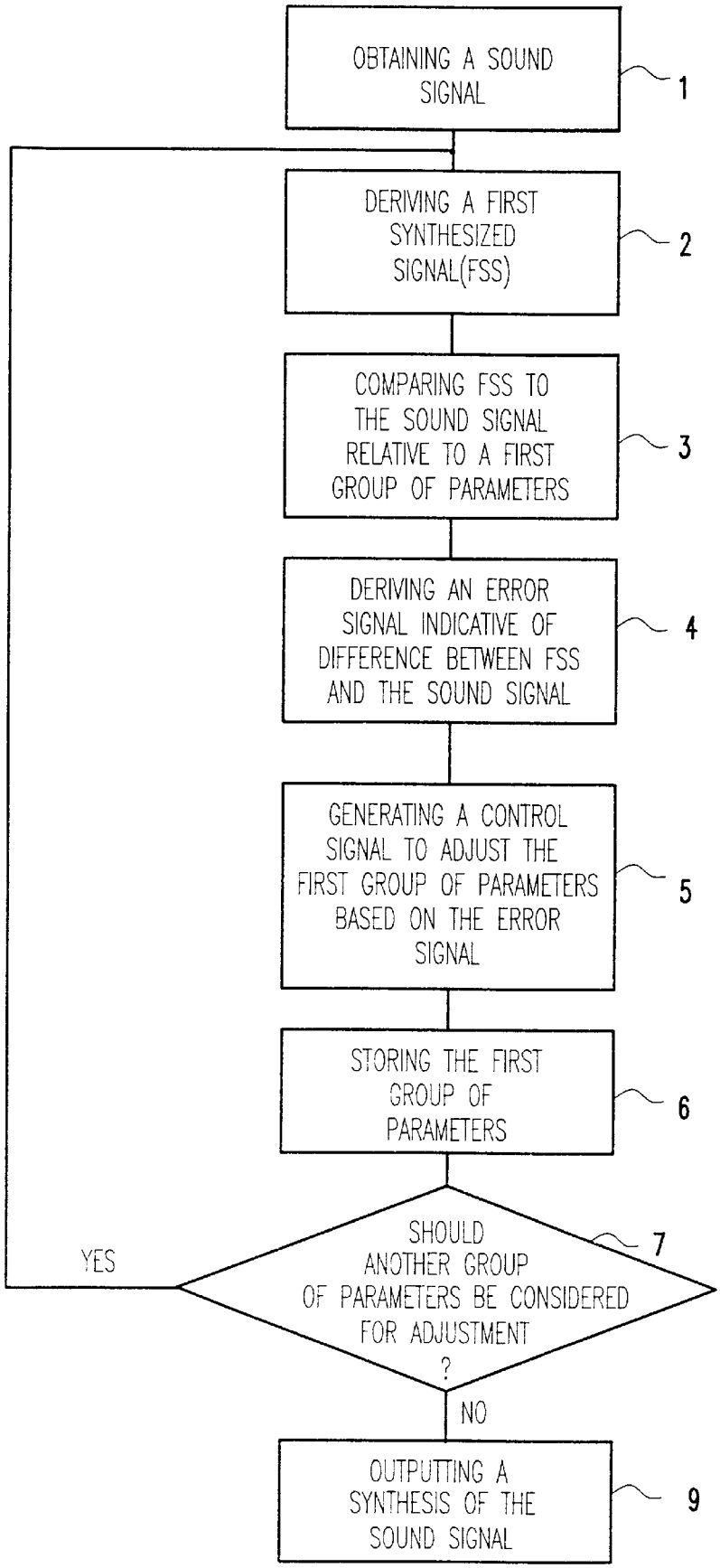
FIG. 2 is a flow diagram of steps included in a first embodiment of the method of the present invention.

FIG. 2 is a flow diagram setting forth steps of a first embodiment of the method of the present invention. In FIG. 2, a first step of the method includes obtaining a sound signal for input into a synthesizer, which may be either analog or digital in nature. (Block 1). The sound signal may be obtained in any manner conventionally known. For example, the sound signal may be one derived directly from a musical instrument, by playing the instrument into a microphone for either instant input into the synthesizer or for storage in memory for later retrieval. If the latter, the memory device for storing the sound signal may be located in the synthesizer or interfaced to the synthesizer as from a computer, another synthesizer, or other independent unit. The memory device may also be a removable storage medium (e.g., tape or disc) readable by the synthesizer. One skilled in the art can appreciate that the sound signal input in accordance with the present invention may by obtained and stored by other techniques or technologies.

A second step of the method includes inputting the sound signal into the synthesizer to derive therefrom a first synthesized signal. (Block 2). The first synthesized signal is generated based on an initial set of parameters corresponding to one or more circuits (e.g., filters, modulators, oscillators) which the synthesizer uses to generate sound. The values of these parameters may correspond to default values set upon startup of the synthesizer, or other values such as those set when the synthesizer was last turned off.

A third step of the method includes comparing the first synthesized signal to the sound signal. (Block 3). As one skilled in the art can appreciate, this comparison may be performed by any conventionally known technique. As an example, the "NULL" test can be used, in which one of the two signals being compared is inverted and summed with the second signal.

A fourth step of the method includes deriving an error signal indicative of differences between the first synthesized signal and the sound signal. (Block 4). This error signal may be produced as a by-product of the comparative techniques performed in the third step. For example, the resulting "sum" signal produced from the NULL test may serve as the error signal. In this case, the larger the discrepancy between the two signals, the greater the magnitude of the error signal. When the error signal is reduced to a null signal, the two signals are equal. One skilled in the art can appreciate that the error signal may be generated by other techniques.

A fifth step of the method includes generating a control signal for adjusting a first group of parameters of the synthesizer. (Block 5). The first group of parameters includes one or more parameters of the circuits which the synthesizer uses to synthesize sound, and as such may include any one or more of the parameters in the initial set of parameters. Preferably, the first group includes a subset of parameters from the initial set of parameters. The control signal adjusts this first group of parameters in such a manner as to reduce, and preferably minimize, differences between the first synthesized signal and the input sound signal, as measured by the error signal derived in the fourth step.

Preferably, the control signal is generated so as to reduce this difference in accordance with optimization techniques, to thereby cause the synthesizer to optimize sound synthesis within the inherent limitations of the synthesizer. An optimization technique employable by the present invention is disclosed, for example, in Wismer et al., "Introduction to Nonlinear Optimization," Elsevier Science Publishing Co., 1978. It is noted that this technique is merely illustrative of the present invention. Those skilled in the art can appreciate that other techniques may be used for reducing the differences between the first synthesized signal and the input sound signal.

Included in the fifth step may be the formation of at least one trial control signal for input into the synthesizer. By way of illustration, in accordance with the aforementioned optimization techniques, a first, or trial, control signal may be generated for varying, either simultaneously or individually in succession, the first group of parameters to cause the synthesizer to generate a second synthesized signal, i.e., a re-synthesis of the input sound signal.

Then, an evaluation may be made to determine whether the adjustments made by the trial control signal caused the second synthesized signal to be a "better" or "worse" synthesis of the sound than the first synthesized signal. This, for example, may be determined in accordance with a trial error signal generated for the purpose of comparing this second synthesized signal with the first synthesized signal.

If the second synthesized signal is determined to be a "better" synthesis than the first synthesized signal, a decision is made whether to generate additional trial control signals in an attempt to further adjust the parameters in the first group of parameters to achieve an even better result, or to stop adjusting any of the first group of parameters and make the trial control signal the control signal produced in the fifth step.

If the second synthesized signal is "worse" than the first synthesized signal, one or more of the first group of parameters is varied in a different manner at least one more time, until a second synthesized signal is produced which represents a "better" synthesis of the input sound signal than the first synthesized signal. If any adjustment to the first set of parameters causes the second synthesized signal to be a "worse" synthesis than the first synthesized signal, then it is concluded that the initial (or default) settings of the one or more parameters being adjusted in the first group of parameters is already at an optimum setting. In such a case, no adjustment is made to these parameters and they, thus, are left at their initial (or default) values.

At the conclusion of the fifth step, the method of the present invention may be considered as having improved the synthesizer for purposes of synthesizing the input sound signal.

An optional sixth step of the method includes storing the first group of parameters as adjusted in the fifth step. (Block 6). This group of parameters may be stored, for example, in a memory of the synthesizer, in an external memory interfaced to the synthesizer, or in a removable storage medium adapted for input into the synthesizer. Further, the first group of parameters may be stored, along with other ones of the initial parameters, to initiate the development of a customized patch which can be recalled from memory to reproduce the sound signal as many times and in as many ways as desired.

In a seventh step of the method, it is determined whether a second group of parameters are to be considered for adjustment. (Block 7). If "YES", the method of the present invention becomes iterative in nature, implementing an analogous application of the steps in at least Blocks 2–6. (Block 8). The second group of parameters may be one or more parameters of the circuits which the synthesizer uses to synthesize the input sound. Further, the second group of parameters may, if desired, include any one or more of the parameters included in the first group of parameters which were considered for adjustment during the first iteration of the method of the present invention.

In still further steps of the method, the steps in at least Blocks 2–5 may be iteratively performed for third and subsequent groups of parameters, with each group containing either parameters not yet considered for adjustment or a combination of those not yet considered and those already considered in previous iterations. The number and contents of all groups of parameters considered for adjustment may be determined in such a manner as to cause the synthesizer to generate an optimized synthesis of the input sound signal.

When the last group of parameters has been considered for adjustment and the answer to the question posed in Block 7 is "NO", the synthesized signal produced from the parameters as adjusted during all iterations of the method is output as an improved synthesis of the sound signal. (Block 8). These parameters, as finally adjusted, which may be considered to define a patch, may then be stored in memory for later recall.

Figure 3:
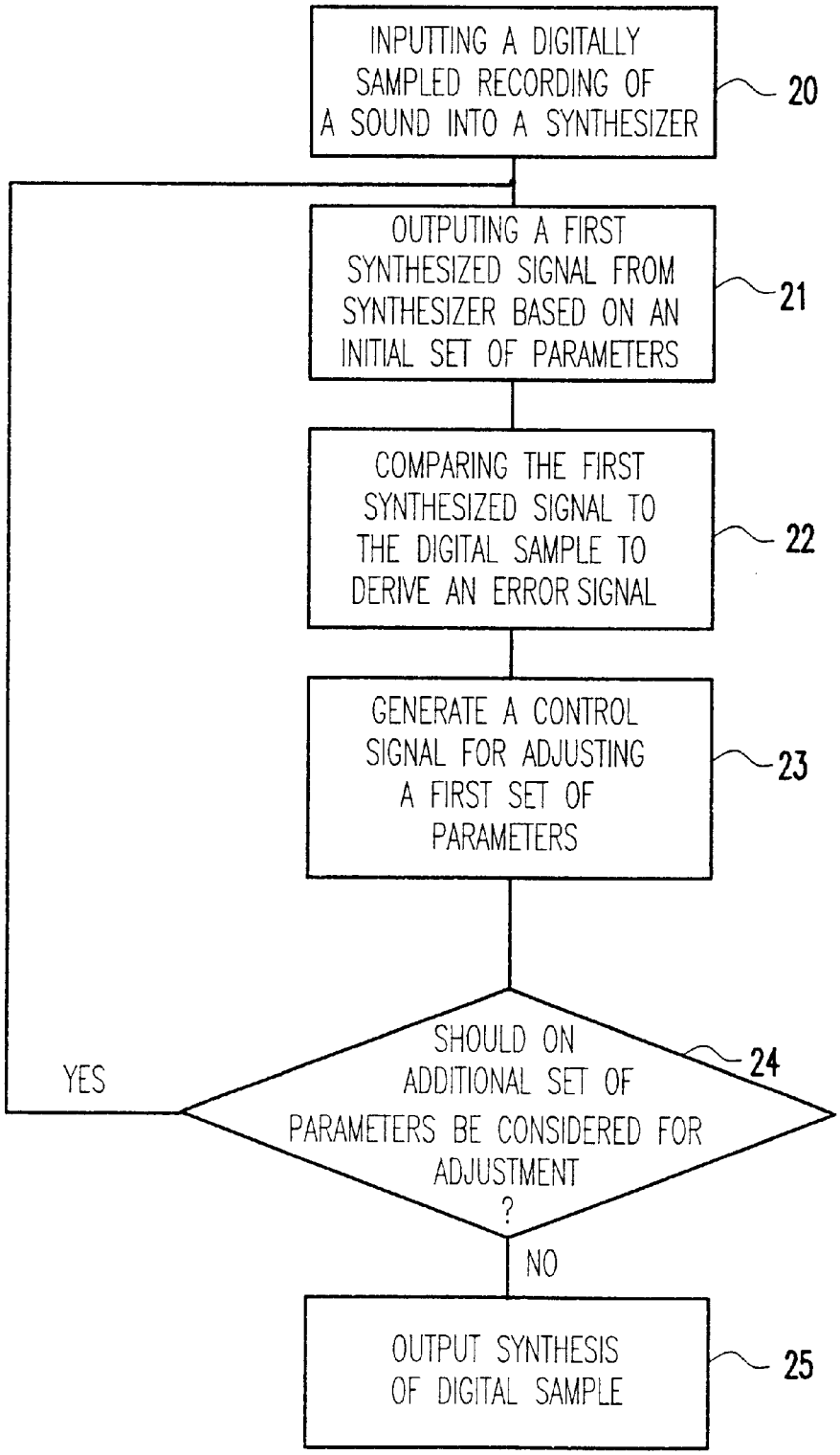
FIG. 3 is a flow diagram of steps included in a second embodiment of the method of the present invention.
Figure 4:
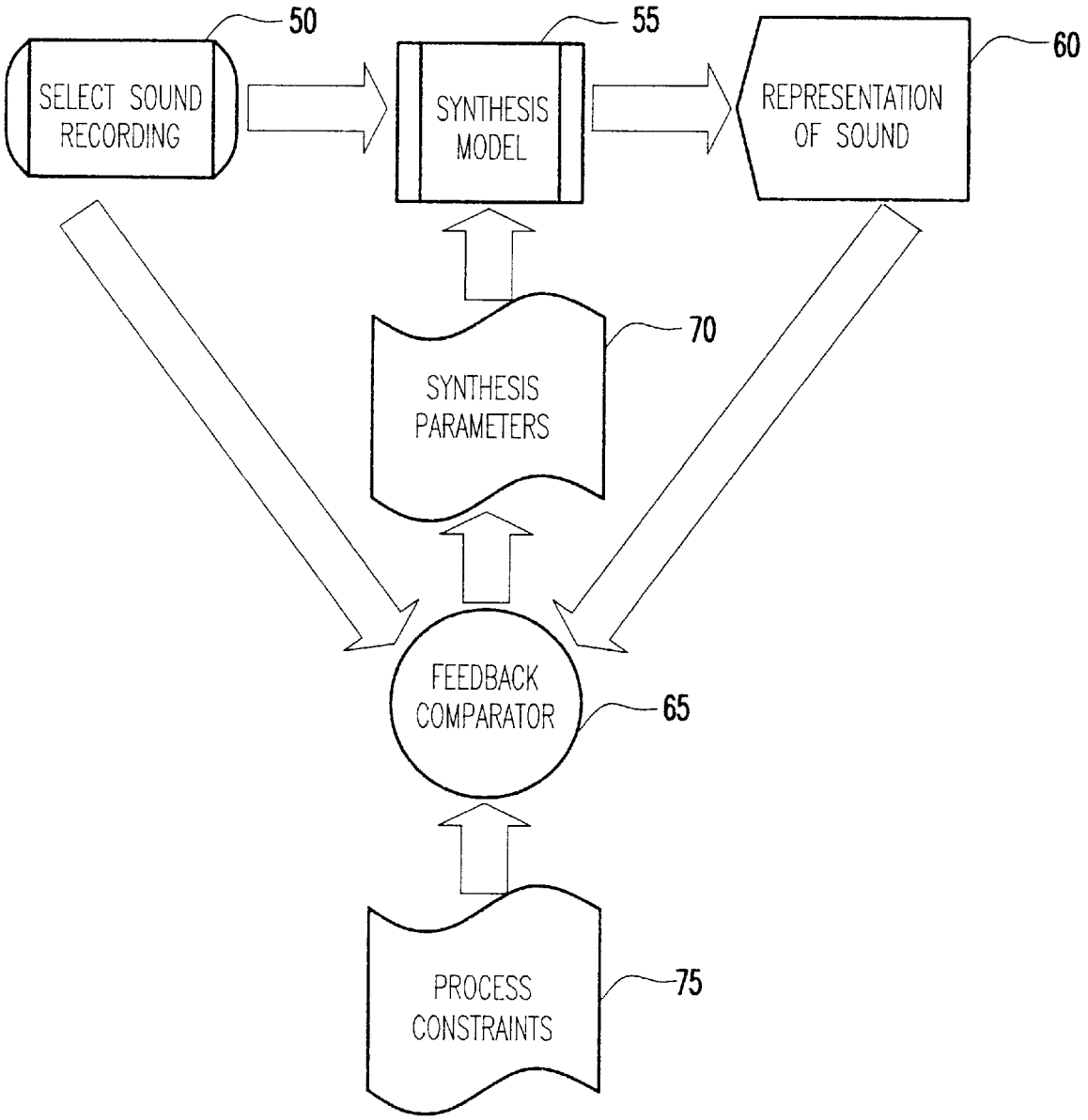
FIG. 4 is a conceptual diagram of steps included in the second embodiment of the method of the present invention.

FIG. 3 is a flow diagram setting forth steps in a second embodiment of the method of the present invention. Reference is made to FIG. 4 which diagrammatically shows implementation of this method.

The method of the second embodiment of the present invention automatically controls the manner in which a digital, sample-based synthesizer generates a sound. As shown in FIGS. 3 and 4, a first step includes inputting a digitally sampled recording of a sound 50 into a digital synthesizer 55. (Block 20). This synthesizer may, if desired, be a type embodied in software for use on a personal or other computer, however those skilled in the art can appreciate that the digital synthesizer may be any other type. The digital sample may be made by the user himself, may be stored in a removable storage medium or other storage device, or may be provided in any other method as one skilled in the art may appreciate. The recordings may span over any range of pitches and volumes.

In a second step, synthesizer 55 outputs a first synthesized signal 60, based on a set of parameters set, for example, to default values. (Block 21). As before, these parameters may correspond to those of one or more filters, modulators, and oscillators of the synthesizer.

In a third step, the first synthesized signal is compared with the digital sample in a feedback comparator 65. (Block 22). The feedback comparator employs comparative techniques, such as those previously mentioned, to derive an error signal indicative of differences between the first synthesized signal and the digital sample.

In a fourth step, a control signal is generated for adjusting a first set of parameters of the synthesizer based on the error signal (Block 23), as shown by reference numeral 70 in FIG. 4. The control signal performs this adjustment, for example, by the aforementioned optimization techniques, to thereby reduce, and preferably minimize, differences between the first synthesized signal and the digital sample. (As before, this step may include generation of one or more trial control signals.) If desired, second and subsequent sets of parameters may be adjusted iteratively (Block 24), until the parameters of the synthesizer are adjusted to produce an optimum synthesis of the input sound recording. (Block 25).

Figure 5:
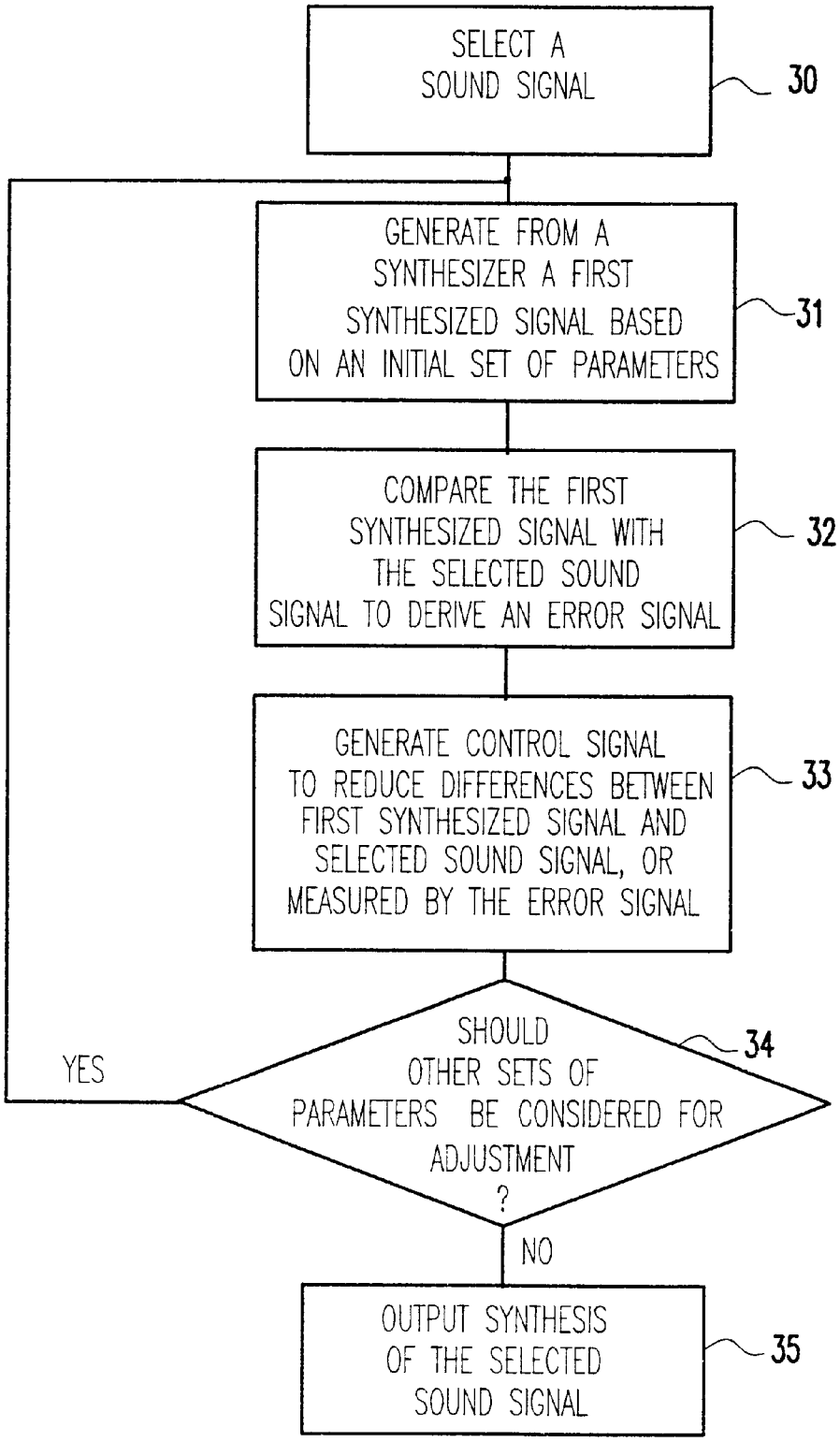
FIG. 5 is a flow diagram of steps included in a third embodiment of the method of the present invention.
Figure 6:
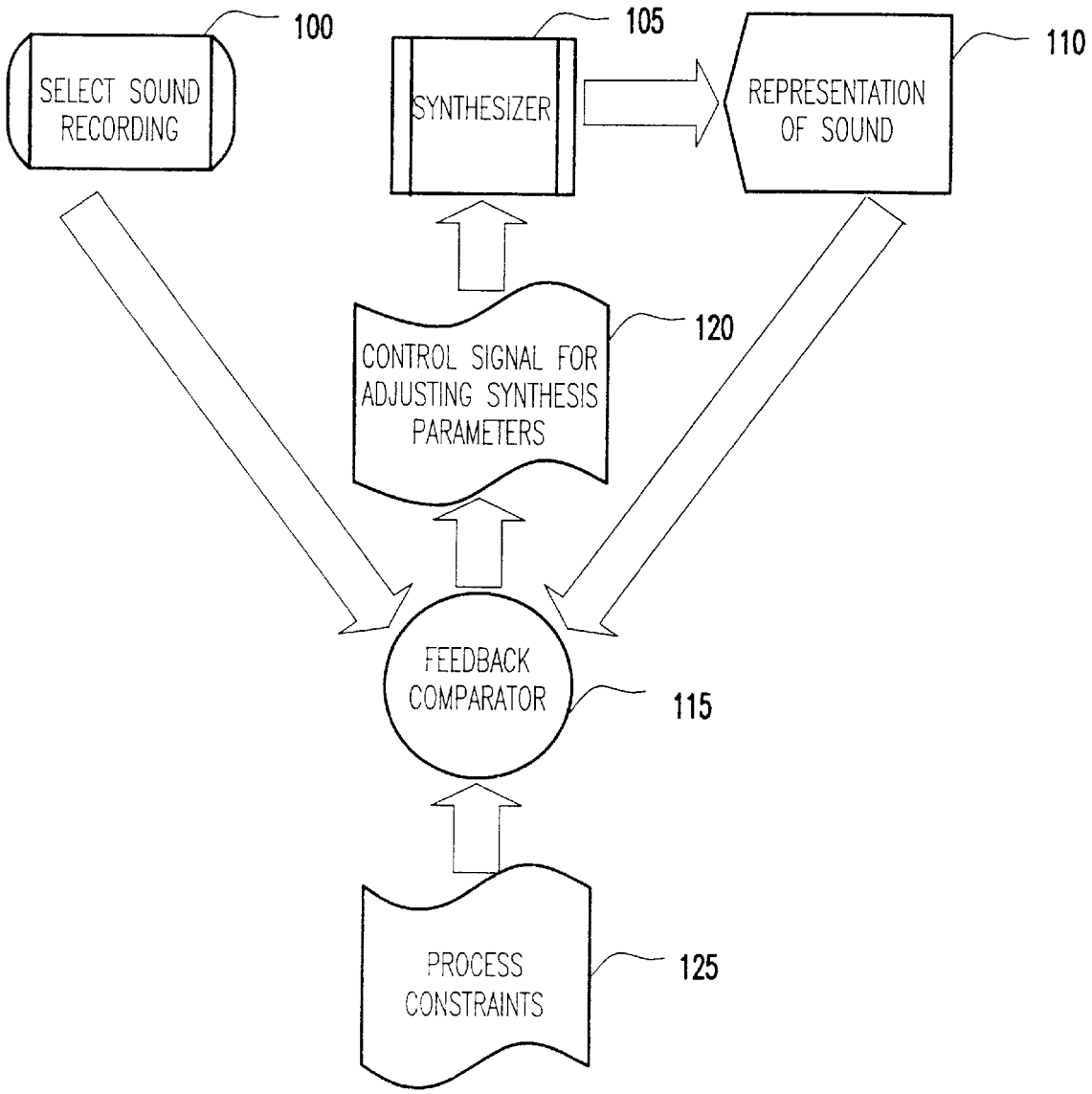
FIG. 6 is a conceptual diagram of steps included in the third embodiment of the method of the present invention.

FIG. 5 is a flow diagram setting forth steps of a third embodiment of the method of the present invention. Reference is made to FIG. 6 which shows a diagrammatic implementation of these steps.

In the third embodiment, the synthesizer being controlled is a type which internally generates a synthesized sound, i.e., one that does not require an input sound signal to generate a synthesized sound. Further, the synthesizer may be analog or digital, and may be embodied either in hardware, e.g. a stand-alone unit such as the Moog and Yamaha DX7 synthesizers, or in software to be run on a computer or other processing device. Further, the steps of the method may themselves be embodied in a computer program run either within the synthesizer itself or ancillary to it, such as in a computer interfaced to the synthesizer unit.

In a first step, a sound signal 100 is obtained for use as a reference for guiding control of the synthesis to be performed by the present invention. (Block 30). (The sound signal, for example, may be selected from among a plurality of sounds stored in a computer running the steps of the method.)

In a second step, a synthesizer 105 internally generates a first synthesized signal based on an initial set of parameters of circuits which the synthesizer uses to synthesis a sound. (Block 31). As shown in FIG. 4, the sound signal selected in the first step is not input into the synthesizer to generate the first synthesized signal. The first synthesized signal is then output as a representation of the selected sound signal 110.

In a third step, the first synthesized signal is compared with the selected sound signal (Block 32) in a feedback comparator, shown as reference numeral 115 in FIG. 4, to derive an error signal representing differences between the first synthesized signal and the selected sound signal. The comparison may be performed and the error signal derived, for example, in accordance with the techniques discussed above in connection with the first embodiment of the present invention.

In a fourth step, a control signal 120 is generated for adjusting a first set of parameters of the synthesizer based on the error signal. (As before, this step may include generation of one or more trial control signals.) The control signal reduces, and preferably minimizes, differences between the first synthesized signal and the selected sound signal. (Block 33). Preferably, the control signal is generated using any of the techniques discussed above in connection with the first embodiment of the invention. Preferably, optimization techniques are used. Also, like in the first embodiment, at the conclusion of the fourth step a second synthesized signal is produced which represents a better, or even optimal, synthesis of the sound signal than the first synthesized signal.

In a fifth step, it is determined whether a second set of parameters are to be considered for adjustment. (Block 34). If "YES", the method of the present invention becomes iterative in nature, implementing an analogous application of the steps in at least Blocks 31–33. The second set of parameters may be one or more parameters of the circuits which the synthesizer uses to synthesize the input sound, or may, if desired, include any one or more of the parameters in the first set of parameters which were considered for adjustment during the first iteration of the method. As in the first embodiment, at the conclusion of the second iteration, the steps in Blocks 31–33 may be analogously performed for third and even subsequent sets of parameters, with each set containing either parameters not yet considered for adjustment or a combination of those not yet considered and those already considered in previous iterations.

When the last set of parameters has been considered for adjustment and the answer to the question posed in Block 34 is "NO", the synthesized signal produced from the parameters as adjusted during all iterations of the method is output as an improved synthesis of the sound signal. (Block 35). These parameters as finally adjusted, which may be considered to define a patch, may then be stored in memory for later recall.

For all of the aforementioned embodiments, in order to generate the control signals for automatically adjusting the parameters of a synthesizer, a number of initialization steps must be performed. One such step includes determining the particular synthesis technique, or model, which the synthesizer is employing to effect sound reproduction. This necessarily requires identification of at least the filters, modulators, oscillators, and other sound-altering elements used by the synthesizer to generate sound, the respective ranges throughout which parameters of each element may be varied, and the particular ways in which these elements may be combined to generate sound. (For example, the cut-off frequencies of the filters and the envelopes/signal wave-forms applied by the modulators are identified in this step. In addition, to produce decay, sustain, and attack effects in the reproduced sound, the specific manner in which the model assigns wave loop points may also be determined.)

Once the synthesis model parameters are identified, another initialization step of the method includes determining which sets of parameters of the synthesizer will be considered for adjustment during the method. Which parameters should be considered for adjustment throughout the iterations of the method may be readily determined by those skilled in the art. The more parameters considered for adjustment, however, the better the synthesis likely to be produced.

Another initialization step includes determining the format which the synthesizer recognizes for accepting parameter-adjusting control signals. This format may be easily determined by one skilled in the art, for example, by referencing the operating manuals supplied with the synthesizer. Typically, the synthesizer will be adjusted by a control signal transmitted according to the MIDI "System-Exclusive" data format. Once initialized, the invention can advantageously adjust the parameters of the synthesizer in the manner previously indicated.

As an optional step, in all of the aforementioned embodiments, the first set, or group, of parameters may, if desired, be adjusted to be within one or more process constraints, as shown by reference numeral 75 in FIG. 4 and 125 in FIG. 6.

These process constraints may include constraints on the operating range of the synthesis parameters. For example, the "attack" time parameter of an envelope generator may be constrained to be an integer value from 0 to 127 in a particular synthesizer, while the same parameter may be a floating point value ranging from 0.001 to 20 seconds on another synthesizer.

Additionally, certain process constraints may be imposed by one employing this method. As an example, the user may desire to impose a limit on the amount of the synthesizer's available storage memory which should be used by a specific sound. One skilled in the art will appreciate that conventional constrained optimization techniques, such as those previously mentioned, can be used to ensure that process constraints such as these are met.

The method of the present invention, as described in all of the foregoing embodiments, represents a significant improvement over approaches conventionally taken for controlling sound synthesis. By adjusting synthesizer parameters automatically, the role of the skilled technician in programming the synthesizer is effectively eliminated in favor of allowing lay persons to perform the invention to generate customized synthesized sounds, for example, in the convenience of their homes or places of work. Over time, if desired, the invention may be used to generate a bank of customized sound patches recallable at will, thus giving users access to synthesized sounds other than those pre-stored patches installed by the manufacturer of the synthesizer.

Further, it is noted that the utility of the present method is limited only by the inherent limitations of the synthesizer being controlled. Otherwise, if enough parameters are considered for adjustment, the method of the present invention may be used to optimize the synthesis of sound, at least to such a degree as is possible by the synthesizer being controlled and so that any remaining differences between the synthesized output and the sound to be replicated is not detectable to the human ear. Accordingly, in computing the difference between the input sound signal and each synthesized signal, a model of human perception may be used so that only those differences humanly perceivable will be reduced, thus saving the invention from having to perform unnecessary adjustments. As one skilled in the art can appreciate, the model of human perception used may be one conventionally known. As an optional step of the method, therefore, only those adjustments which produce changes in the signals that are humanly perceivable are considered as improvements.

To optimize versatility, the method of the present invention can be implemented in both software and hardware, or as a combination of both. The present method is particularly well suited to being embodied in a program for execution on a personal or other computer. The invention, however, may just as easily be implemented by other processing devices, including, for example, a processor chip in the synthesizer itself or one in a stand-alone unit interfaced to the synthesizer.

Further, if the synthesizer is also in program form, a computer program embodying the method of the present invention may be stored separately in the computer, but in such a way that it interfaces with the synthesizer program to synthesize desired sounds. For example, a program embodying the present method may be an applications program implemented in a windows-based environment and operated in conjunction with the synthesizer program based on mouse-input commands. Alternatively, the synthesizer program may be modified to incorporate the present invention.

It may also be appreciated by one skilled in the art that if the present invention is embodied in an application program, a user may use the audio features of the computer to input the sound signals to be reproduced. Optionally, the signals may be input from an external source through a communications port of the computer, or from a removable storage medium (e.g., a magnetic or optical disc, or digital audio tape) inserted into the computer.

Embodying the method of the present invention in a computer program is advantageous for a number of additional reasons. First, doing so will allow the invention to interface to practically any type of synthesizer, including those presently known or ones to be developed. A software implementation of the method, therefore, with periodic upgrades, will protect the invention from becoming obsolete when more sophisticated, future-generation synthesizers are developed.

Second, a computer-program version of the present method may allow all the initialization steps of the method to be written into the program, thereby alleviating the need of a user to perform them manually. Instead, a user need only call the program and input the sound signal to be reproduced, and the method will thereafter automatically adjust the parameters of the synthesizer to produce a high-quality synthesis of the desired sound.

Third, a computer-program version of the present method may allow configurations for a plurality of synthesizers (e.g., various brand-name synthesizers) to be pre-stored in memory. A user, therefore, may automatically initialize the method to control different types of synthesizers, merely by designating, for example, on a graphical user-interface of the computer (e.g., via mouse selection) a pre-stored configuration corresponding to the synthesizer. Upon such a designation, the method would then be automatically initialized to produce control signals compatible with the synthesizer for automatically adjusting the parameters therein.

Other manifestations of the method of the present invention may also be apparent to those skilled in the art. For example, the method of the present invention may be embodied within a computer card inserted into slot of a personal computer. The computer card may include its own processor for performing the method, or may use one or more processors of the computer to perform the steps thereof. An on-card processor may, for example, be a co-processor or a specially dedicated processor.

If the synthesizer is a stand-alone unit in the form of, for example, an electronic musical instrument such as the Kurzweil 2500S synthesizer, a computer program embodying the present invention may be adapted to interface with the synthesizer unit through the communications ports of the computer and synthesizer. In such a situation, the control signals generated by the present method may be input into a MIDI port of the synthesizer, such as one compatible with MIDI Sample Dump, Downloadable Sound as described in the "DLS" specification, or SoundFont of Creative Labs SoundFont.

Alternatively, a control program of the stand-alone synthesizer unit may be modified to incorporate a computer program embodying the method of the present invention. The method may then be implemented, for example, by operating the controls of the synthesizer. The sound reproductions formed may then be stored in the synthesizer unit along with other patches, or may be written to a removable storage medium to allow a user the carry the sound reproduction with him for reproducing the sound at remote locations. Further, the sound reproductions generated by the present method may be downloaded across the internet for replay by a remote user.

Other modifications and variations to the invention will be apparent to those skilled in the art from the foregoing disclosure. Thus, while only certain embodiments of the invention have been specifically described herein, it will be apparent that numerous modifications may be made thereto without departing from the spirit and scope of the invention.

I claim:

1. A method for controlling a synthesizer, comprising:

(a) obtaining a sound signal;

(b) deriving a first synthesized signal from the synthesizer based on an initial set of parameters of the synthesizer;

(c) comparing the first synthesized signal to the sound signal to derive an error signal indicative of a difference between the first synthesized signal and the sound signal;

(d) generating a control signal, based on said error signal, for adjusting a first group of parameters of the synthesizer to reduce the difference between the first synthesized signal and the sound signal, said first group of parameters being at least a subset of the initial set of parameters; and (e) deriving a second synthesized signal from the synthesizer based on at least said first group of parameters as adjusted by the control signal in step (d), said second synthesized signal being a more accurate synthesis of the sound signal than said first synthesized signal.

2. The method of claim 1, wherein at least steps (b)–(e) are performed automatically by a computer program.

3. The method of claim 1, wherein step (a) includes a step of inputting the sound signal into the synthesizer to derive the first synthesized signal derived in step (b).

4. The method of claim 1, wherein, in step (b), the first synthesized signal is internally generated from the synthesizer.

5. The method of claim 1, further comprising:

determining whether a second group of parameters of the synthesizer are to be considered for adjustment, and if so;

comparing the second synthesized signal to the sound signal to derive a second error signal indicative of a difference between the second synthesized signal and the sound signal;

generating a second control signal, based on said second error signal, for adjusting a second group of parameters of the synthesizer to reduce the difference between the second synthesized signal and the sound signal; and deriving a third synthesized signal from the synthesizer based on at least said second group of parameters as adjusted by the second control signal, said third synthesized signal being a more accurate synthesis of the sound signal than said second synthesized signal.

6. The method of claim 1, further comprising:

wherein said second group of parameters is a subset of said initial set of parameters.

7. The method of claim 6, wherein said second set of parameters may include any one or more of said first set of parameters.

8. The method of claim 2, wherein if a second group of parameters of the synthesizer are not to be considered for adjustment, said method further comprises:

outputting said second synthesized signal.

9. The method of claim 1, further comprising:

storing at least said first group of parameters as a recallable patch in a memory.

10. The method of claim 2, further comprising:

storing at least said second group of parameters as a recallable patch in a memory.

11. The method of claim 1, wherein said first group of parameters has only one parameter.

12. The method of claim 1, wherein the synthesizer is one of a digital synthesizer and an analog synthesizer.

13. The method of claim 1, wherein the control signal is generated using optimization techniques to reduce the difference between the first synthesized signal and the sound signal by an optimum amount.

14. The method of claim 1, further comprising:

arranging the control signal in a format compatible with a MIDI port of the synthesizer.

15. The method of claim 14, wherein said format is compatible with one of MIDI Sample Dump, Downloadable Sound, and SoundFont.

16. The method of claim 1, wherein the control signal adjusts the first group of parameters so as to be within predetermined process constraints of the synthesizer.

17. The method of claim 16, wherein said predetermined process constraints include at least one of constraints on an operating range of one or more synthesizer parameters and constraints on an amount of memory to be allocated for storing a sound.

18. The method of claim 1, wherein the initial set of parameters includes at least one parameter of a filter, modulator, oscillator, and loop point of the synthesizer.

19. The method of claim 1, wherein the control signal is generated in step (d) only if the difference between the first synthesized signal and the sound signal is detectable based on a model of human perception, and if not detectable, no adjustment to the first group of parameters is made.

20. The method of claim 2, wherein said computer program is one of an applications program executed on a computer interfaced to the synthesizer and one executed by a processor of the synthesizer.

21. The method of claim 1, wherein said group of parameters includes a plurality of parameters.

22. The method of claim 13, wherein in accordance with said optimization techniques, step (d) further comprises:

generating a trial control signal for adjusting said first group of parameters in a first direction to produce a trial synthesized sound;

determining whether said trial synthesized sound is a better or worse synthesis of the sound signal than said first synthesized sound;

if said trial synthesized sound is a worse synthesis: generating a second trial control signal for adjusting said first group of parameters in a second direction to produce a second trial synthesized sound which is a better synthesis of the sound signal than said trial synthesized sound, and generating additional trial control signals, if needed, to generate an optimal trial synthesized sound based on adjustment of said first group of parameters, said optimal trial synthesized sound being said second synthesized signal; and if said trial synthesized sound is a better synthesis: generating additional trial control signals, if needed, to generate an optimal trial synthesized sound based on adjustment of said first group of parameters, said optimal trial synthesized sound being said second synthesized signal.

* * * * *